US012584643B2

(12) United States Patent
Schreiber

(10) Patent No.: US 12,584,643 B2
(45) Date of Patent: Mar. 24, 2026

(54) MODULAR RETURN AIR DEVICE

(71) Applicant: SLD Technology, Inc., Portland, OR (US)

(72) Inventor: Kevin Joseph Schreiber, Portland, OR (US)

(73) Assignee: SLD Technology, Inc., Portland, OR (US)

( * ) Notice: Subject to any disclaimer, the term of this patent is extended or adjusted under 35 U.S.C. 154(b) by 637 days.

(21) Appl. No.: 17/748,570

(22) Filed: May 19, 2022

(65) Prior Publication Data

US 2022/0390130 A1 Dec. 8, 2022

Related U.S. Application Data

(60) Provisional application No. 63/190,238, filed on May 19, 2021.

(51) Int. Cl.
*F24F 7/007* (2006.01)
*F24F 8/20* (2021.01)
*F24F 11/63* (2018.01)

(52) U.S. Cl.
CPC ..... *F24F 7/007* (2013.01); *F24F 11/63* (2018.01)

(58) Field of Classification Search
None
See application file for complete search history.

(56) References Cited

U.S. PATENT DOCUMENTS

2018/0106491 A1* 4/2018 Abrishamkar ..... F24F 1/68

FOREIGN PATENT DOCUMENTS

KR 20090098514 A * 9/2009
KR 101381209 B1 * 4/2014

OTHER PUBLICATIONS

KR101381209 and translation (Year: 2018).*
KR20090098514 and translation (Year: 2009).*

* cited by examiner

*Primary Examiner* — Steven S Anderson, II
(74) *Attorney, Agent, or Firm* — Evan R. Sotiriou; Burris Law, PLLC

(57) ABSTRACT

A modular return air device includes a body and a first air return configured to facilitate incoming air to enter the body, wherein the body has a grille and a damper. The modular return air device further includes one or more sensors configured to collect data regarding the incoming air and a second air return configured to facilitate the air to exit the body of the modular return air device.

17 Claims, 7 Drawing Sheets

MODULAR RETURN AIR DEVICE

CROSS-REFERENCE TO RELATED APPLICATIONS

This non-provisional application claims the benefit of and priority to U.S. Provisional Application No. 63/190,238, filed May 19, 2021. The disclosure of the prior application is hereby incorporated by reference herein in its entirety.

BACKGROUND

An air return, or air return vent, removes air from a space as part of a heating, ventilation, and air conditioning (HVAC) system. Air returns are used in numerous residential and commercial settings, for example in medical suites in order to maintain a sterile environment for medical imaging settings, surgical settings, and so forth. Current air returns merely return air to an HVAC system without enabling external and/or electronic control of the return, and are difficult and time-consuming to install, update, service, and replace.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In various examples, a modular return air device comprises a body and a first air return configured to facilitate incoming air to enter the body, wherein the body comprises a grille and a damper. The modular return air device further comprises one or more sensors configured to collect data regarding the incoming air and a second air return configured to facilitate the air to exit the body of the modular return air device.

In various examples, a modular return air device comprises a body and a first air return configured to receive incoming air into the body, wherein the body comprises a grille and a damper. The modular return air device further comprises a second air return configured to allow air to exit the body, wherein the body is configured for modular installation within a room.

In various examples, a method for monitoring air quality within a room comprises receiving an incoming airflow within an air return of a modular return air device within a room and collecting data regarding the incoming airflow using one or more sensors of the modular return air device. The method further comprises monitoring the airflow using the collected data and controlling air within the room based at least in part on the monitored airflow.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

The examples disclosed herein may take physical form in certain parts and arrangement of parts, and will be described in detail in this specification and illustrated in the accompanying drawings which form a part hereof and wherein.

DETAILED DESCRIPTION

Figure 1:
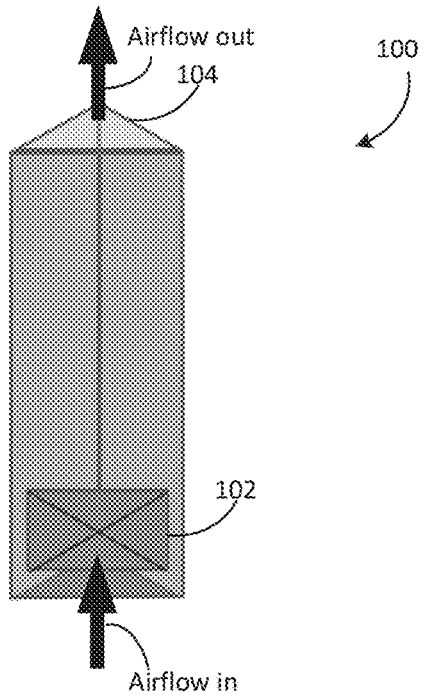
FIG. 1 is a diagram illustrating airflow through a modular return air device according to various examples.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Various examples of the present disclosure provide a modular return air device. The modular return air device in some examples include one or more sensors that provide feedback on air characteristics and disinfecting components configured to treat the returning air, among other types of feedback. The modular return air device further includes installation elements such as integrated finish channels to create sealed connections to established walls and support the modular return air device.

Accordingly, various examples and implementations of the present disclosure enable improved airflow throughout a room, such as surgical suite, via the modular return air device configured as a "smart" modular return air device. By enabling rapid and high-quality installation, the modular return air device is able to provide improved airflow through, for example, a surgical suite or patient room without the time-consuming installation and structural modifications conventionally needed for improved airflow systems. Furthermore, the modular return air device improves the airflow by providing specific feedback and analysis of air entering the modular return air device in order to further improve the air being introduced into the surgical suite.

FIG. 1 illustrates an example modular return air device 100 according to various examples of the disclosure. The modular return air device 100 illustrated in FIG. 1 is for illustration only. Various examples of the modular return air device 100 can be used without departing from the scope of the present disclosure.

As illustrated in FIG. 1, the modular return air device 100 includes a first air return 102 configured to allow air to flow from a space (illustrated as Airflow In), such as a surgical suite, into the return and a second air return 104 configured to allow air to flow from the return (illustrated as Airflow Out) to additional components of an HVAC system. In other words, in various examples, the first air return 102 is configured to facilitate airflow into the modular return air device 100 and the second air return 104 is configured to facilitate airflow out of the modular return air device 100 as the first step of airflow into an HVAC system. It should be appreciated that one or more of the modular return air devices 100 can be provided and located in different positions and orientations within a room, a building, etc.

Figure 2:
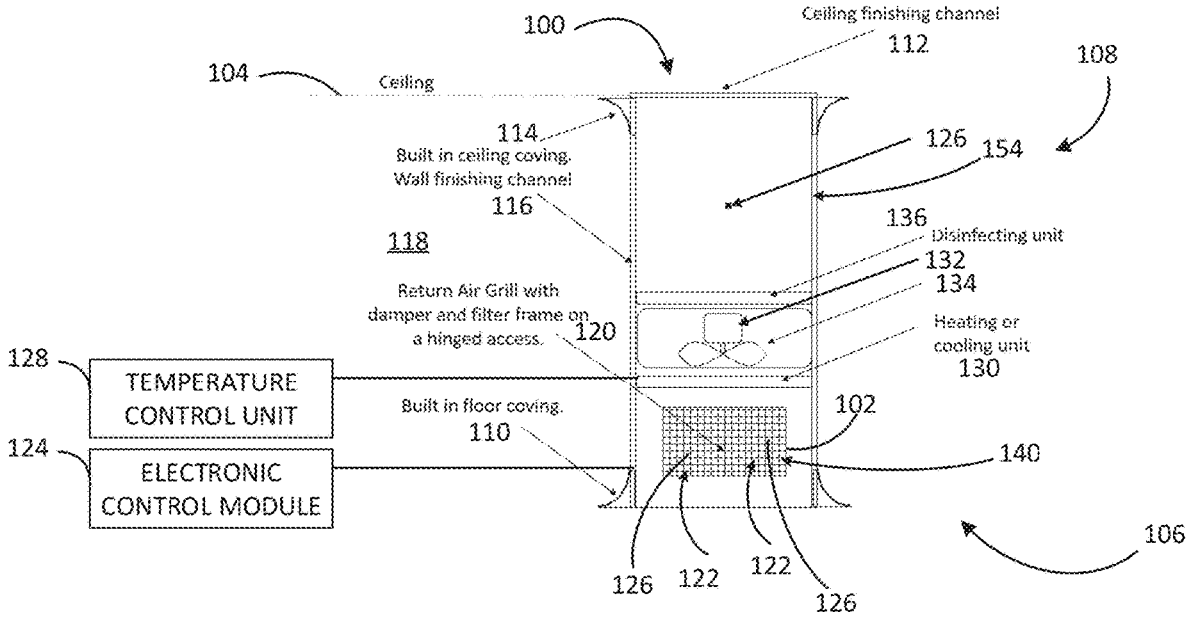
FIG. 2 is another diagram illustrating a modular return air device according to various examples.

FIG. 2 illustrates an example modular return air device 100 according to various examples of the disclosure. The modular return air device 100 illustrated in FIG. 2 is for illustration only. Various examples of the modular return air device 100 can be used without departing from the scope of the present disclosure.

The example modular return air device 100 illustrated in FIG. 2 is shown installed in a space 108, such as a surgical suite. Accordingly, FIG. 2 illustrates the structural relationship between the modular return air device 100 and a ceiling 104. The modular return air device 100 extends from a floor 106 to the ceiling 104 of the space 108, and includes a built-in floor coving 110, such as a curved or shaped strip of wood or other material fitted as a feature that creates a seal between the modular return air device 100 and the floor 106 and a ceiling finishing channel 112 (e.g., at one or more junctions), and a built-in ceiling coving 114, that create a seal between the modular return air device 100 and the ceiling 105. The modular return air device 100 further includes a wall finishing channel 116 that creates a seal between the modular return air device 100 and at least one wall 118 on which the modular return air device 100 is installed. Various examples of the modular return air device 100 can be installed against one wall 118 or, as described in greater detail below, in a corner of a space against two or more walls 118. That is, the number, positioning, and/or orientation of the modular return air device 100 can be varied as desired or needed. The seals between the modular return air device 100 and each contacting surface, such as the floor 106, ceiling 104, and one or more walls 118, prevents air from escaping the modular return air device 100 and becoming trapped between the modular return air device 100 and a surface in various examples, which could lead to contamination of the space 108. Different types of seals and sealing arrangements are contemplated by the present disclosure. For example, any type of air sealing member (e.g. gaskets, sealants, etc.) can be used.

The modular return air device 100 extends at least to the ceiling 100 and, in some examples, at least to a point above the ceiling 104. For example, the ceiling 104 can include a portion that is removed to create a hole for the modular return air device 100 to extend through. The built-in ceiling coving 114 creates the seal between the modular return air device 100 and the hole in the ceiling 104 through which the modular return air device 100 extends. At a point above the ceiling 104, the modular return air device 100 then connects, for example, to additional components of the HVAC system, such as via ductwork, to return the air from the space 108 to the central portion of the HVAC system.

In operation, as illustrated in FIG. 2, air enters the modular return air device 100 through a return air grille 120 at the first air return 102. In some examples, the return air grille 120 includes one or more holes or openings 122 to facilitate the flow of air into the modular return air device 100 from the space 108. In some examples, the return air grille 120 includes a damper 140, filter frame, and louver that is hinged to provide access from the space 108 to install an air filter and adjust the amount of airflow to be allowed through the return air grille 120 at any one time. In some examples, the damper 140 is able to be manually adjusted, such as by a user, by mechanically adjusting the damper 140 to allow more or less airflow into the modular return air device 100 through the return air grille 120. In some examples, the damper 140 is able to be controlled via a controller, such as an electronic control module 124 communicatively coupled to modular return air device 100 and accessed by a user. In some examples, the damper 140 is automatically controlled by the electronic control module 124 based on feedback received throughout the HVAC system of which the modular return air device 100 is included. For example, the feedback can include feedback received from one or more sensors 126 on or in the modular return air device 100. For example, one or more sensors 126 in some examples are positioned along or within the airflow path of the modular return air device 100, such as at the first air return 102 to sense the airflow through the return air grille 120. It should be noted that the number an positioning of the sensors 126 is shown merely as an example. One or more sensors 126 can additionally or alternatively be positioned within the return air grille 120, at the second air return 104, etc. In various examples, the one or more sensors 126 are communicatively coupled to the electronic control module 124, such as via a wired or wireless connection.

The modular return air device 100 in various examples further includes a temperature control unit 128 communicatively coupled to the modular return air device 100 to control the temperature of the air that flows through the modular return air device 100. The temperature control unit controls a heating or cooling unit 130 having a heating element to heat air received in the modular return air device 100 and a cooling element to cool air received in the modular return air device 100. In examples where the air received in the modular return air device 100 is determined to be a temperature that is too low, the heating element can be activated in order to heat the air as the air passes through the modular return air device 100. Conversely, in examples where the air received in the modular return air device 100 is determined to be a temperature that is too high, the cooling element can be activated in order to cool the air as the air passes through the modular return air device 100. In various examples, the temperature control unit 128 can be activated or operated manually by a user, electronically by a user (which may be via the electronic control module 124), or automatically based on feedback received throughout the HVAC system, including but not limited to feedback received from the one or more sensors 126 on or in the modular return air device 100. In some examples, the heating and cooling elements, and the temperature control unit 128, can be positioned in different locations and/or orientations. It should be noted that the heating and cooling elements can be, for example, any type of HVAC elements that operate to heat or cool air, respectively.

The modular return air device further includes a motor 132 and a fan 134 to provide active airflow through the modular return air device 100 in some examples. The fan 134 is powered by the motor 132 and in one or more examples controls the rate at which air is drawn into the modular return air device 100, through the first air return 102, and at which air is drawn out of the modular return air device 100 through the second air return 104. In various examples, the motor 132 and the fan 134 can be activated manually by a user, electronically by a user via the electronic control module 124, or automatically based on feedback received throughout the HVAC system, including but not limited to feedback received from the one or more sensors 126 on or in the modular return air device 100. As such, dynamic control of airflow through the modular return air device 100 is provided in various examples.

The modular return air device 100 further includes a disinfecting unit 136 to disinfect air flowing through the modular return air device 100 in various examples. The disinfecting unit 136 can include disinfecting elements to disinfect the air by using disinfecting technology including, but not limited to, ultraviolet (UV) light, UVC, Far-UVC, Near UV, 405 nm wavelength light, vaporized hydrogen peroxide (VHP), and so forth. In various examples, the disinfecting unit 136 can be activated manually by a user, electronically by a user via the electronic control module 124, or automatically based on feedback received throughout the HVAC system, including but not limited to feedback received from the one or more sensors 126 on or in the modular return air device 100.

It should be appreciated that the modular return air device 100 can include additional or different components or elements. For example, additional or different air control devices, air cleaning devices, air monitoring devices, air testing devices, etc. can be installed within the modular return air device 100 and are contemplated by the present disclosure. That is, different sensing, monitoring, control, etc. devices can be implemented in connection with the herein described examples. It should also be noted that a body 154 of the modular return air device 100 can include within, coupled thereto, and/or formed therewith, one or more aspects or components described herein, such as the return air grille 120, the damper 140, etc.

Figure 3:
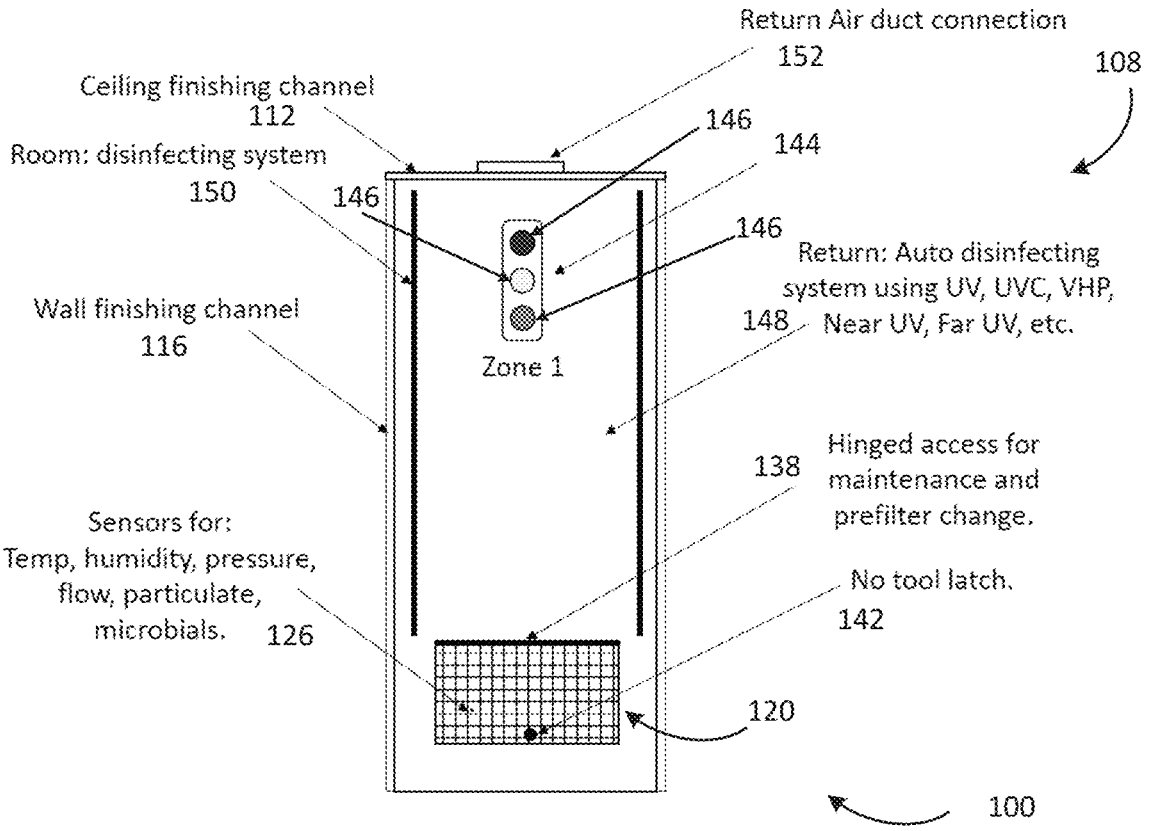
FIG. 3 is another diagram illustrating a modular return air device according to various examples.

FIG. 3 illustrates an example modular return air device 100 according to various examples of the disclosure. The modular return air device 100 illustrated in FIG. 3 is for illustration only. Various examples of the modular return air device 100 can be used without departing from the scope of the present disclosure. It should be noted that one or more aspects described herein can be used in combination with other aspects.

The example modular return air device 100 illustrated in FIG. 3 includes the ceiling finishing channel 112 and the wall finishing channel 116 that create a seal between the modular return air device 100 and the ceiling 104 and the wall 118, respectively, of the space 108 in which the modular return air device 100 is installed. As shown in FIG. 3, the modular return air device 100 further includes the return air grille 120 illustrated in FIG. 2 to provide hinged access via a hinge 138 to the modular return air device 100 for ease of maintenance and prefilter replacement, when necessary or desired. In this example, a latch, configured as a no-tool latch 142 is provided to allow the hinged access without a tool.

In the illustrated example, the modular return air device 100 includes the one or more sensors 126 (one sensor 126 is shown for ease of illustration). The one or more sensors 126 can be provided on the exterior of and/or inside the modular return air device 100. The one or more sensors 126 in various examples collect and measure one or more characteristics and/or properties (e.g., collect data) of the air that flows into and/or through the modular return air device 100. For example, the one or more sensors 126 include, but are not limited to, sensors that measure one or more of temperature, humidity, pressure, rate of airflow, volume of airflow, particulate speed, particulate counts, microbial size, microbial counts, microbial types, and so forth of the air flowing through the modular return air device 100. In some examples, the data obtained from the one or more sensors 100 is used to control one or more of the damper 140 on the return air grille 120, the temperature control unit 128, the motor 132 and the fan 136, and the disinfecting unit 136. In some examples, the data obtained from the one or more sensors 126 is displayed on the electronic control module 124 for viewing by the user. In these examples, the user can manually control or electronically control, via the electronic control module 124, one or more of the damper 140 on the return air grille 120, the temperature control unit 128, the motor 132 and the fan 134, and the disinfecting unit 136 based on the viewed data. In some examples, automatic control of different components to change the airflow, the quality of the air, etc. is performed.

In some examples, the data obtained by the one or more sensors 126 is received and analyzed by an electronic device, such as the electronic control module 124, which acts or operates as a "smart" modular return air device. The electronic control module 124 can include various electronic components as described in more detail herein, such as a memory, processor, presentation components, and so forth. The processor executes one or more programs stored on the memory to analyze the obtained data. In some examples, the obtained data can be compared with thresholds or threshold ranges for each piece of data or dataset obtained. For example, the memory can store a threshold range for a temperature of the air flowing into the modular return air device 100. The threshold range can be a single threshold, a single threshold range, or include varying levels of acceptability. For example, an optimal temperature for the surgical suite in which the modular return air device is installed can be 68° Fahrenheit. A temperature range from 67° to 69° can be considered to be "optimal", a temperature range from 65° to 67° and/or from 69° to 71° can be considered to be "acceptable", and a temperature range below 65° and/or above 71° can be considered to be "unacceptable". The threshold levels can be provided by displaying raw data, such as the temperature of the air flowing into the modular return air device 100, and/or by displaying a visual indication of the temperature of the air flowing into the modular return air device 100. For example, an indicator, such as a visual indicator 144 (e.g., visual indicating elements having one or more lights or indicators), configured to provide a visual indication can be displayed on the presentation component of the electronic control module 124 and/or or the modular return air 100 device itself, as illustrated in FIG. 3.

FIG. 3 illustrates an example wherein the visual indicator 144 is configured and/or operating as an environmental status indicator that displays a different color based on the obtained sensor data. For example, when an indicator 146 the visual indicator 144 is displayed green, the temperature range is within the "optimal" range, when the indicator 146 is displayed yellow, the temperature range is within the "acceptable" range, and when the indicator 146 is displayed red, the temperature range is within the "unacceptable" range. It should be appreciated that in various examples the indicator 146 is configured as an environmental status indicator that provides an indication of one or more environmental air conditions, such as related to the airflow, and can be used as feedback as described in more detail herein. It should be noted that the number, positioning, orientation, type, configuration, etc. of the indicators 146 can be varied as desired or needed, such as based on the type of information to be displayed or indicated.

Although described herein as depicting a visual indication based on data from a particular sensor 126, various examples are contemplated. In some examples, an "optimal" indication is displayed based on all sensor data indicating optimal thresholds. The indication can change to a visualization of other than "optimal" based on data from a single sensor 126 indicating levels rather than optimal and/or based on data from a certain number of sensors 126 (e.g., a subset of sensors 126, which may be in a certain area or location of the modular return air device 100) indicating levels that are less than optimal. In some examples, the visual indication is configured to display a visualization for data from a particular sensor 126, and which is switchable between sensor data in some examples (e.g., data from different sensors 126). In some examples, the visual indication displays a visualization for data from different sensors 126 on a timer-based cycle that changes at regular intervals. In some examples, the visual indication includes a separate visual indicator 144 for data from each particular sensor 126 included in the modular return air device 100.

As shown in FIG. 3, in this example, the modular return air device 100 further includes the disinfecting unit 136 configured as an automatic (auto) disinfecting system 148, and more particularly, as a return air disinfecting system. The automatic disinfecting system 148 in some examples includes the disinfection unit 136 described herein. For example, the modular return air device 100 includes one or more disinfecting elements to disinfect the air by using disinfecting technology including, but not limited to, ultraviolet (UV) light, UVC, Far-UVC, Near UV, 405 nm wavelength light, vaporized hydrogen peroxide (VHP), and so forth. The automatic disinfecting system 148 may be integrated with (e.g., communicatively coupled with) the one or more of the sensors 126, such as sensors 126 that detect particulate levels, microbial levels, and so forth. In some examples, the one or more sensors 126 can detect levels of particulates and/or microbials present in the air entering the modular return air device 100. Based on the detected particulate and/or microbial levels, the automatic disinfecting system 148 identifies the type of disinfecting elements to activate to disinfect the incoming air, an amount, e.g., volume, of disinfect to use to disinfect the incoming air, an amount of time to activate the identified disinfecting elements, and so forth, to automatically disinfect the incoming air to the modular return air device 100.

As shown in FIG. 3, in this example, the modular return air device 100 further includes elements configured as a room disinfecting system 150. The room disinfecting system 150 is provided to disinfect the space 108, such as the room, where the modular return air device 100 is provided. In other words, the room disinfecting system 150 provides a mechanism to disinfect air in the space 108 before the air the returned through the modular return air device 100. The room disinfecting system 150 includes one or more disinfecting elements to disinfect the air by using disinfecting technology including, but not limited to, ultraviolet (UV) light, UVC, Far-UVC, Near UV, 405 nm wavelength light, vaporized hydrogen peroxide (VHP), and so forth. In some examples, the room disinfecting system 150 is integrated with (e.g., communicatively coupled with) the electronic control module 124 such that the electronic control module 124 controls the elements of the room disinfecting system 160. It should be noted that the room disinfecting system 150 can be located within and/or external to the modular return air device 100 (e.g., within and/or external to the body of the modular return air device 100).

As shown in FIG. 3, in this example, the modular return air device 100 further includes a return air duct connection 152. The return air duct connection 152 is provided above the ceiling finishing channel 112 such that the ceiling finishing channel 112 is provided between the return air duct connection 152 and the additional elements of the modular return air device 100, such as the sensors 126, the return, and so forth. The return air duct connection 152 is the connection point between, for example, the modular return air device 100 and the duct through which air passes to be returned to the central HVAC unit from the modular return air device 100.

Figure 4:
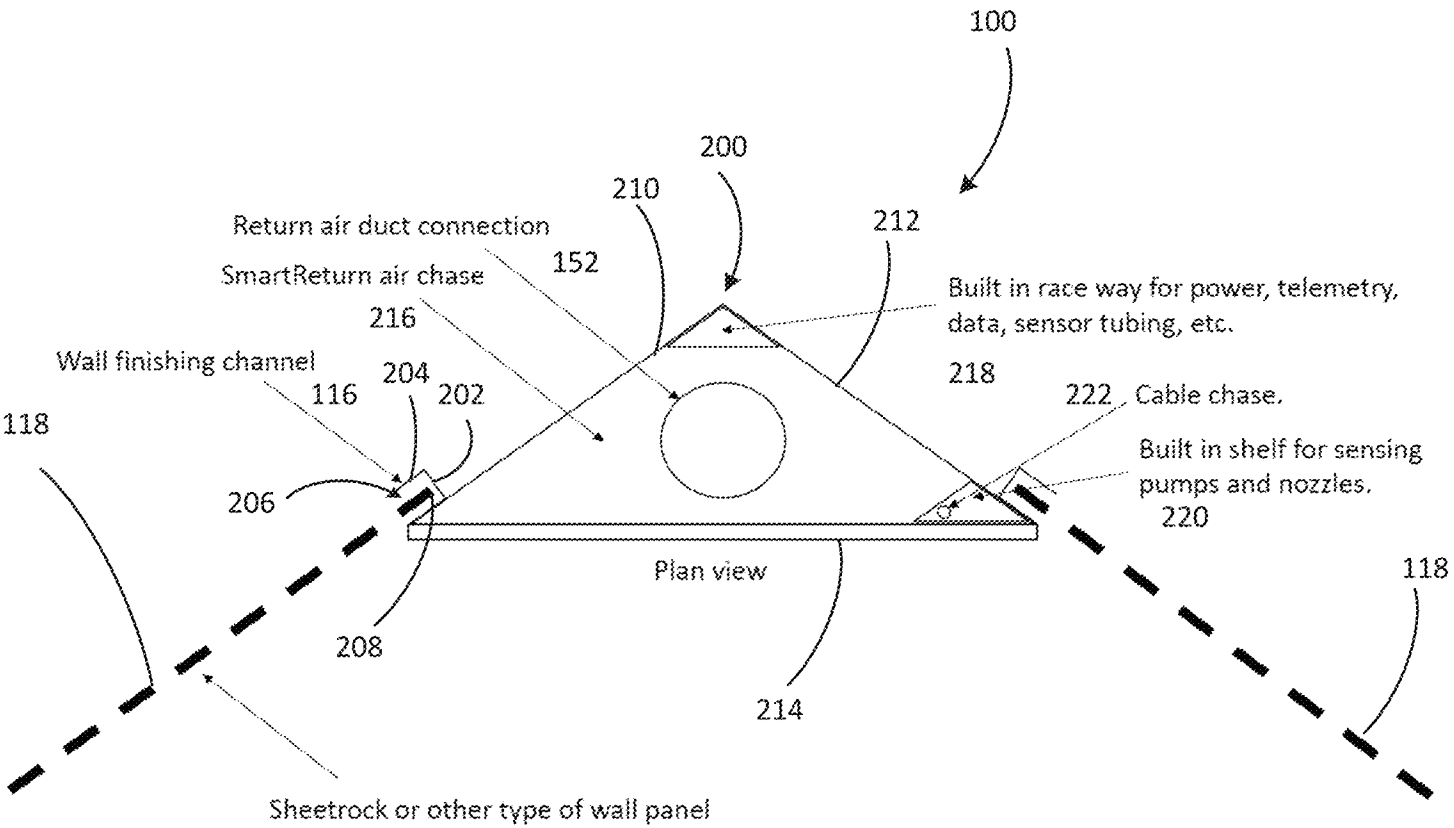
FIG. 4 is a cut-through view of a modular return air device according to various examples.

FIG. 4 illustrates a cut-through view of an example modular return air device 100 according to various examples of the disclosure. The modular return air device 100 illustrated in FIG. 4 is for illustration only. Various examples of the modular return air device 100 can be used without departing from the scope of the present disclosure. The cut-through view of FIG. 4 is a plan view of the modular return air device 100.

The modular return air device 100 illustrated in FIG. 4 is installed at a corner of two walls. The modular return air device can be installed at a corner 200 of two walls 118 in a medical setting, such as a surgical suite, or in other settings without departing from the scope of the present disclosure. In particular, FIG. 4 illustrates the modular return air device 100 installed at the corner 200 of two walls panels, such as sheetrock panels, but the modular return air device 100 can be installed at the corner 200 of other types of wall panels or against a single wall panel without departing from the scope of the present disclosure. In some examples, as illustrated in FIG. 4, the modular return air device 100 is provided in a triangular prism shape. In other examples, the modular return air device 100 is provided in a rectangular prism shape or any other suitable shape, as well as in any suitable or desired position, location, and/or orientation. As should be appreciated, the modular return air device 100 can be configured as desired or needed, such as based on the configuration of the space 108.

In some examples, the modular return air device 100 includes the wall finishing channel 116 that creates a seal between the modular return air device 100 and the wall panel. Each wall finishing channel 116 includes a first portion 202 that extends perpendicular to a side of the modular return air device 100 and a second portion 204 that extends from the first portion 202 and is parallel to the side of the modular return air device 100. Together the first portion 202 and the second portion 204 form a channel 206, or groove, to receive an end 208 of the wall panel defining the wall 118. A segment of the side of the modular return air device 100 on which the wall finishing channel 116 is included overlaps with the wall panel. The wall finishing channel 116 creates the seal between the modular return air device 100 to prevent air from being trapped behind the modular return air device 100. In examples where the modular return air device 100 is provided in the triangular prism shape, a first side 210 is parallel to a first wall panel with a first wall finishing channel 116, a second side 212 is parallel to a second wall panel with a second wall finishing channel 116, and a third side 214 faces the space in which the modular return air device 100 is installed and includes the return air grille 120 as described herein to facilitate the flow of air into the modular return air device 100. As such, the modular return air device 100 is configured for modular installation within a room, such as, for example, providing easier installation and maintenance.

In some examples, the modular return air device 100 includes an air chase 216. The air chase 216 allows air to flow through the modular return air device 100 from the space 108 in which the modular return air device 100 is installed to an air handler, such as the main HVAC system which includes the modular return air device 100. In some examples, the air chase 100 is or includes a duct. The air chase 100 in some examples includes additional components of the modular return air device 100 described herein, such as the sensors 126, the automatic disinfecting system 148, the heating and cooling unit 130, the motor 132 and the fan 134, and so forth. In some examples, air enters the air chase 216 via the first air return 102 via the return air grille 120, flows through the air chase 216, and exits the air chase 216 via the second air return 104.

In some examples, the modular return air device 100 includes additional components that support the additional components of the modular return air device 100. For example, as illustrated in FIG. 4, the modular return air device 100 includes a race way 218, or channel, to allow power cables, telemetry, data, sensor tubing, and so forth to be housed in the modular return air device 100 while being physically separated and/or insulated from the air flowing through the air chase 216. In some examples, the modular return air device 100 further includes a shelf 220 (e.g., a built in or integrated shelf) upon which various components, such as sensing pumps, sensing nozzles, one or more sensors, and so forth can be stored. The shelf 220 provides a stable supporting location for the various components. In some examples, the modular return air device 100 further includes a cable chase 222 that allows various cables to extend through the air chase 222. The cable chase 222 can be provided in the shelf 220, as illustrated in FIG. 4, so that cables do not have to be routed around the shelf 220, or separate from the shelf 220.

As shown in FIG. 4, the modular return air device 100 further includes the return air duct connection 152 as described herein. In particular, the return air duct connection 152 connects the modular return air device 100 and the duct through which air passes to be returned to the central HVAC unit from the modular return air device 100. Although illustrated in FIG. 4 as circular in shape, the return air duct connection 100 can be provided in any shape suitable to connect the modular return air device 100 and the duct to the central HVAC unit. In various examples, the return air duct connection 100 can be circular, square, rectangular, triangular, and so forth.

Figure 5:
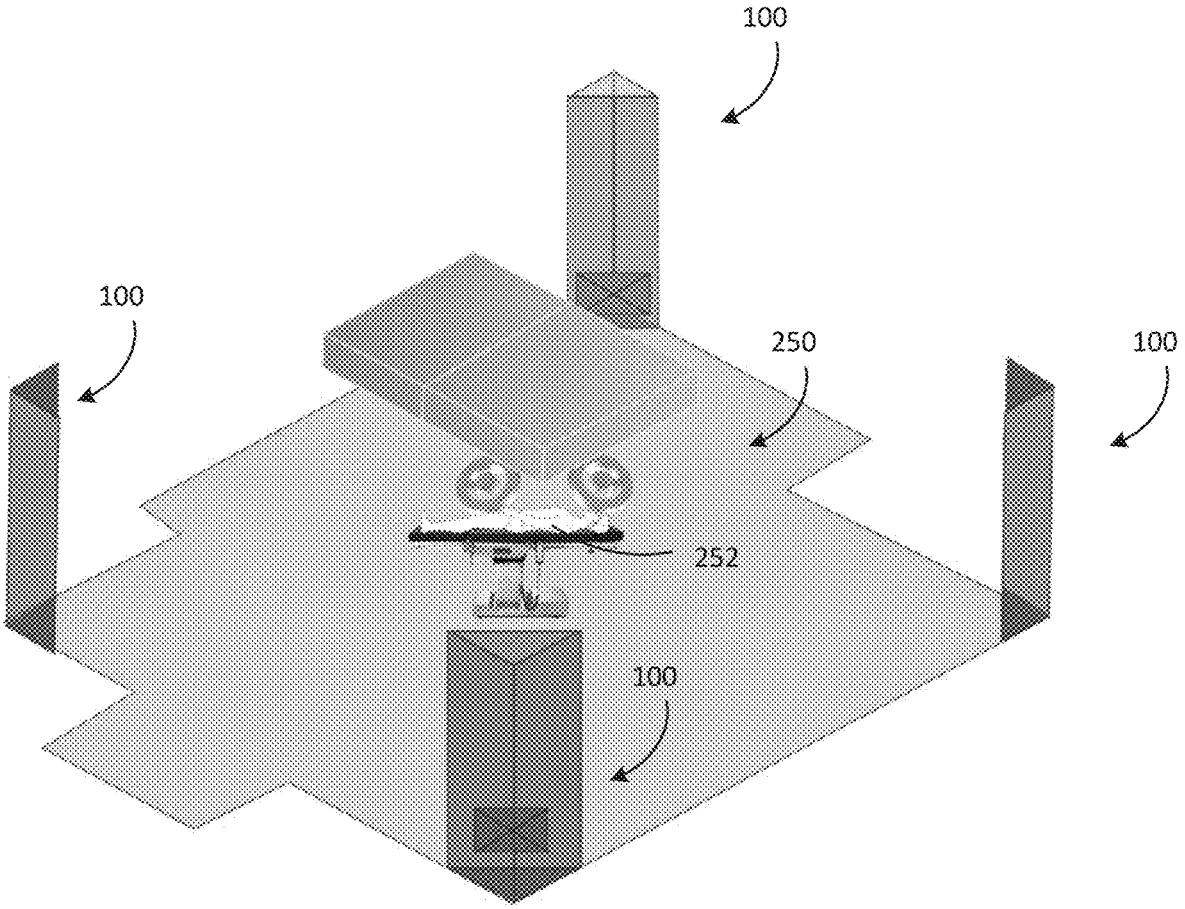
FIG. 5 is a diagram illustrating a surgical suite having modular return air devices according to various examples.

FIG. 5 illustrates a perspective view of a surgical suite 250 that includes a plurality of modular return air devices 100 according to various examples of the disclosure. The surgical suite 250 illustrated in FIG. 5 is for illustration only. Various examples of the surgical suite 250 can be used without departing from the scope of the present disclosure.

As shown in FIG. 5, the surgical suite 250 includes a separate modular return air device 100 in four separate corners. Each of the modular return air devices 100 illustrated in FIG. 5 is configured according to various examples provided herein. By implementing multiple modular return air devices 100 in different areas of a single surgical suite 250, air from different areas of the surgical suite 250 can be continually returned to the central HVAC system and monitored. In other words, each separate modular return air device 100 provides feedback data to the electronic control module 124 regarding the temperature, humidity, particulate levels, and so forth of the air flowing through the particular modular return air device 100. When implemented in a system that includes multiple modular return air devices 100, characteristics of air in different areas of the surgical suite 250 can be monitored and adjusted, via the electronic control module 124 to maintain desirable characteristics of the air in the surgical suite 250 having, for example, a patient 252 therein. As described herein, the modular return air devices 100 can be differently positioned or oriented as desired or needed. Also, the number of modular return air devices 100 can be varied as desired or needed.

Figure 6:
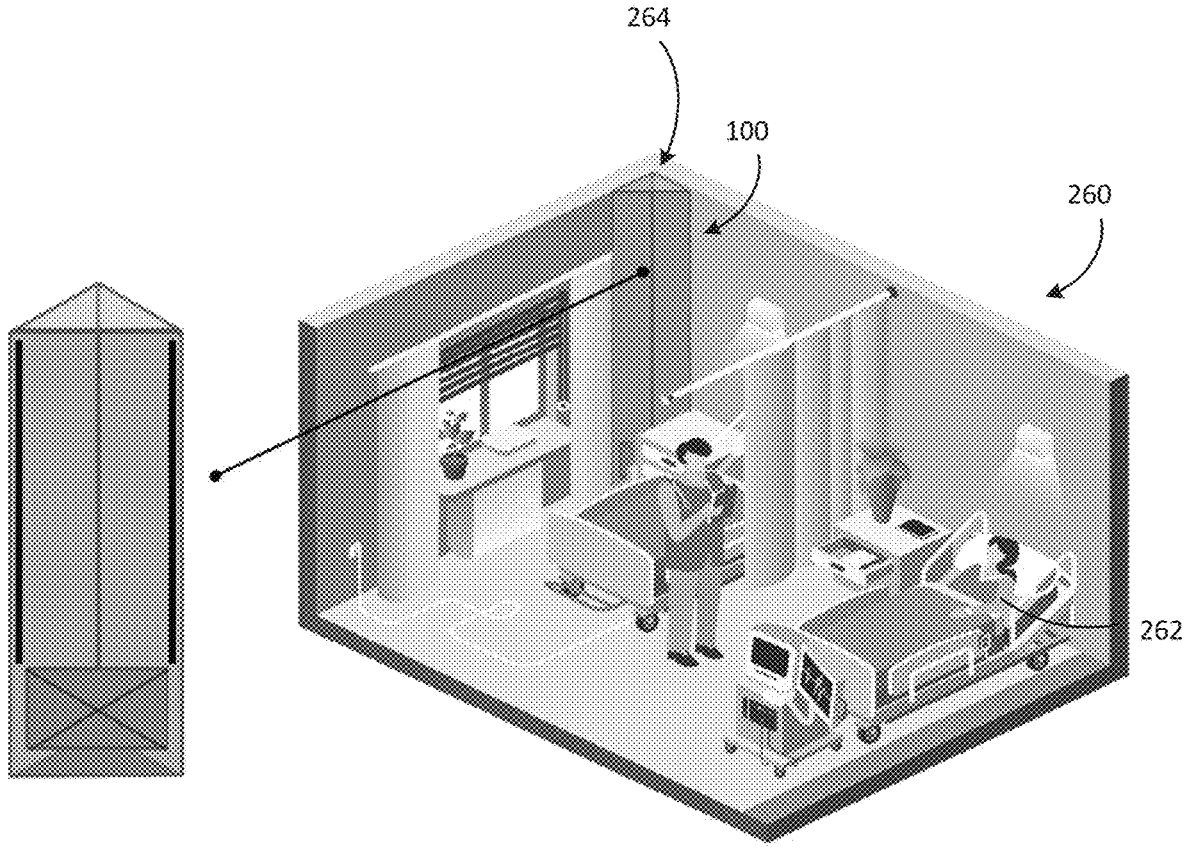
FIG. 6 is a diagram illustrating a patient room having a modular return air device according to various examples.

FIG. 6 illustrates a perspective view of a patient room 260 that includes one or more modular return air devices 100 (one modular return air device 100 is shown) according to various examples of the disclosure. The patient room 260 illustrated in FIG. 6 is for illustration only. Various examples of the patient room 260 can be used without departing from the scope of the present disclosure.

The patient room 260 is another example of a space in which the modular return air device 100 is implemented. The patient room 260 can be, for example, a post-operation recovery room, a pre-operation preparation room, an examination room, and so forth, for a patient 262. As shown in FIG. 6, the patient room 260 includes the modular return air device 100 in at least one corner 264. While FIG. 6 illustrates a modular return air device 100 in one corner 264 of the patient room 260, various examples are possible, and a separate modular return air device 100 can be provided in each corner 264 of the patient room 260, or in other locations. The modular return air device 100 illustrated in FIG. 6 is configured according to various examples provided herein. In other words, the modular return air device 100 illustrated in FIG. 6 provides feedback data to the electronic control module 124 regarding the temperature, humidity, particulate levels, and so forth of the air flowing through the modular return air device 100 as described herein. When implemented in a system that includes multiple modular return air devices 100, characteristics of air in different areas of the patient room 260 can be monitored and adjusted, via the electronic control module 124 to maintain desirable characteristics of the air in the patient room.

In some examples, the electronic control module 124 is a central system or apparatus provided to control various operations of the space 108, such as the surgical suite 250 or the patient room 260, in which the modular return air device 100 is provided. The sensor feedback data provided to the electronic control module 124 by the modular return air device 100 enables the electronic control module 124 to analyze the feedback data for impact on the environmental conditions to automatically adjust control settings for the air in the space 108. The control settings for the air can be automatically adjusted to clean the incoming air via the automatic disinfecting system, the temperature can be automatically adjusted via the cooling and heating unit, the rate of airflow can be automatically controlled via the motor and fan, and so forth.

In some examples, the present disclosure can be implemented with co-pending application having application Ser. No. 17/747,223 entitled "Modular Patient Lift System" and with co-pending application having application Ser. No. 63/190,241 entitled "Central Medical Suite System", and with co-pending application Ser. No. 17/529,010 and co-pending application Ser. No. 17/694,377; and with U.S. Pat. Nos. 9,671,100, 9,895,202, 9,903,115, and 10,405,942.

Figure 7:
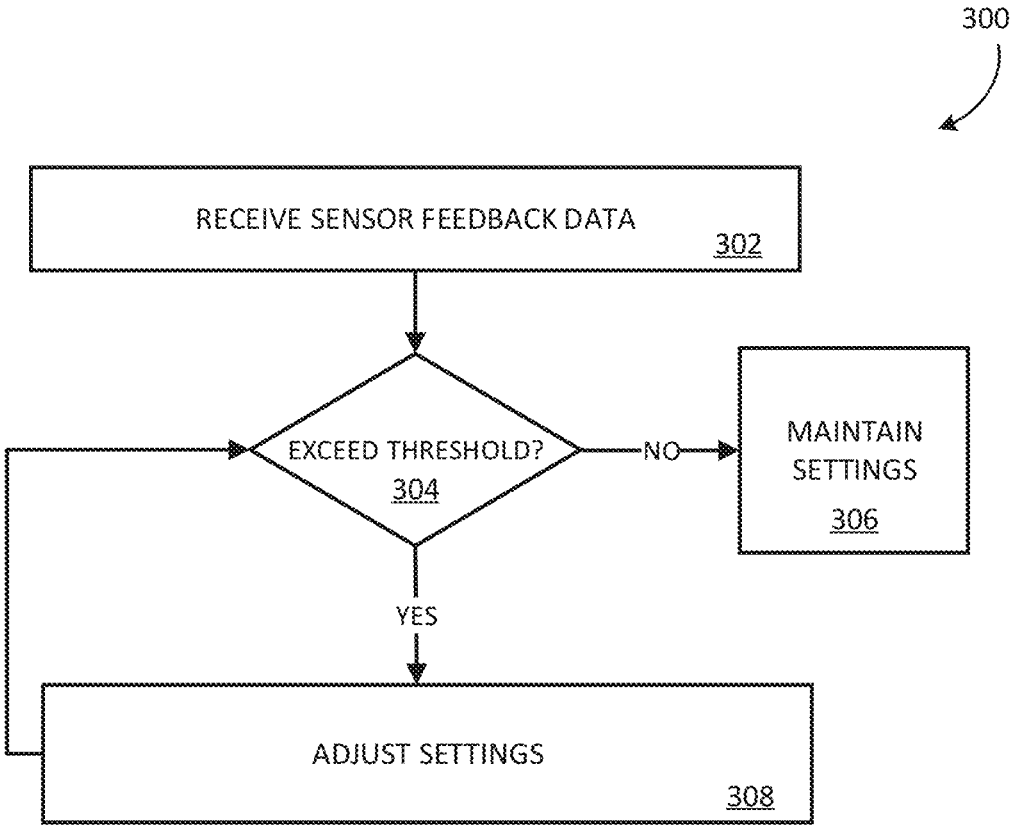
FIG. 7 illustrates an example of a method for controlling return air according to various examples.

The electronic control module 124 in various examples is configured to monitor and/or control air flow, air quality, and other air parameters or characteristics using the modular return air device 100, as illustrated in the flowchart 300 of FIG. 7. For example, the electronic control module 124 in some examples is operable to generate one or more control signals to control one or more components, operations, etc. of the modular return air device 100. That is, in one or more examples, the flowchart 300 illustrates operations involved in generating one or more control signals for controlling operation of the modular return air device 100 and/or an associated HVAC system, such airflow, disinfection, air temperature, air humidity, etc. monitored by the modular return air device 100. In some examples, the operations of the flowchart 300 generate signals to control operation of the modular return air device 100 as described herein. The flowchart 300 commences at operation 302 with receiving sensor feedback data. For example, the electronic control module 124 receives measurements, sensed data, etc. from one or more of the sensors 126 as described in more detail herein. A determination is then made at 304 whether the received data, exceeds a threshold at 304. For example, a determination is made whether the measurements exceed an air quality level, a temperature level, a humidity level, etc. It should be noted that different threshold levels or values can be defined for different operating conditions, different patients, different surgical suites, etc. That is, the thresholds in some examples are defined to monitor or control operations and/or conditions relating to a particular configuration or setting.

If a determination is made that none of the one or more thresholds is exceeded, the settings for the various operations are maintained at 306. That is, the settings for the operation of the HVAC and/or the modular return air device 100, such as speed, airflow, etc. are maintained at a current level or state at 306. If a determination is made that one or more of the thresholds is exceeded, then one or more settings are adjusted at 308. For example, a speed, airflow, amount of sanitizing, etc. are adjusted at 308. The adjustment can include an increase or decrease in one or more settings. It should be noted that in some examples, the settings are for operation of the modular return air device 100 (such as to adjust airflow or sanitation) and in some examples the exceeded threshold causes one or more control signals to be sent to the HVAC system (or other system) to change one or more settings (e.g., change one or more settings to affect the air quality or an air characteristic within the space 108).

Thus, one or more examples provide a modular return air device 100 providing, for example, improved air return monitoring and air quality control. For example, improved control and/or monitoring is provided by various examples.

Figure 8:
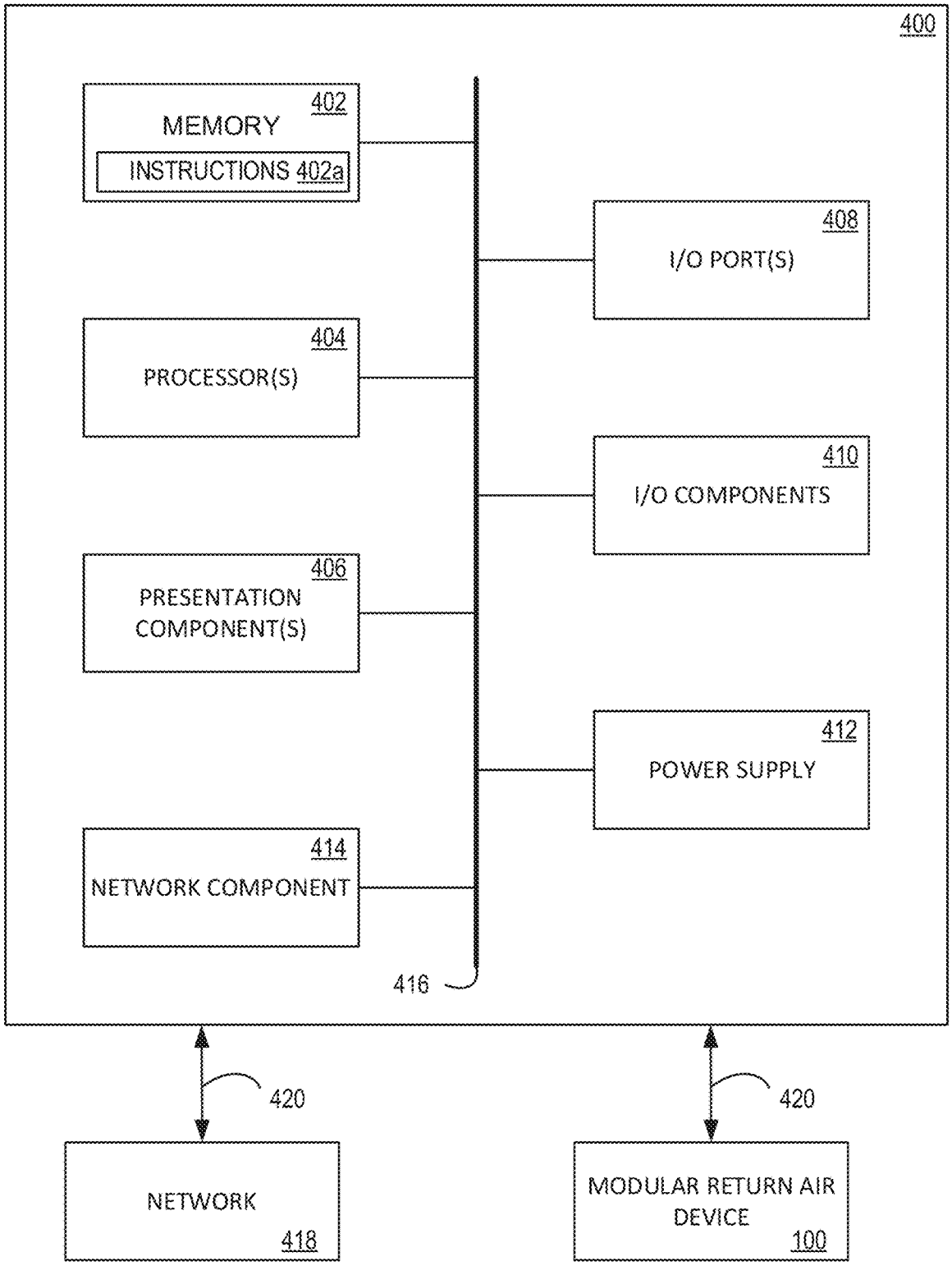
FIG. 8 is a block diagram of a computing environment suitable for implementing various examples.

With reference now to FIG. 8, a block diagram of a computing device 400 suitable for implementing various aspects of the disclosure as described (e.g., operations or functions to control the modular return air device 100). FIG. 8 and the following discussion provide a brief, general description of a computing environment in/on which one or more or the implementations of one or more of the methods and/or system set forth herein may be implemented. The operating environment of FIG. 8 is merely an example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, mobile consoles, tablets, media players, and the like), multiprocessor systems, consumer electronics, mini computers, mainframe computers, distributed computing environments that include any of the above systems or devices, and the like.

Although not required, implementations are described in the general context of "computer readable instructions" executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

In some examples, the computing device 400 includes a memory 402, one or more processors 404, and one or more presentation components 406. The disclosed examples associated with the computing device 400 are practiced by a variety of computing devices, including personal computers, laptops, smart phones, mobile tablets, hand-held devices, consumer electronics, specialty computing devices, etc. Distinction is not made between such categories as "workstation," "server," "laptop," "hand-held device," etc., as all are contemplated within the scope of FIG. 8 and the references herein to a "computing device." The disclosed examples are also practiced in distributed computing environments, where tasks are performed by remote-processing devices that are linked through a communications network. Further, while the computing device 400 is depicted as a single device, in one example, multiple computing devices work together and share the depicted device resources. For instance, in one example, the memory 402 is distributed across multiple devices, the processor(s) 404 provided are housed on different devices, and so on.

In one example, the memory 402 includes any of the computer-readable media discussed herein. In one example, the memory 402 is used to store and access instructions 402*a* configured to carry out the various operations disclosed herein. In some examples, the memory 402 includes computer storage media in the form of volatile and/or nonvolatile memory, removable or non-removable memory, data disks in virtual environments, or a combination thereof. In one example, the processor(s) 404 includes any quantity of processing units that read data from various entities, such as the memory 402 or input/output (I/O) components 410. Specifically, the processor(s) 404 are programmed to execute computer-executable instructions for implementing aspects of the disclosure. In one example, the instructions 402*a* are performed by the processor 404, by multiple processors within the computing device 400, or by a processor external to the computing device 400. In some examples, the processor(s) 404 are programmed to execute instructions such as those illustrated in the flow charts discussed herein and depicted in the accompanying drawings.

In other implementations, the computing device 400 may include additional features and/or functionality. For example, the computing device 400 may also include additional storage (e.g., removable and/or non-removable) including, but not limited to, magnetic storage, optical storage, and the like. Such additional storage is illustrated in FIG. 8 by the memory 402. In one implementation, computer readable instructions to implement one or more implementations provided herein may be in the memory 402 as described herein. The memory 402 may also store other computer readable instructions to implement an operating system, an application program and the like. Computer readable instructions may be loaded in the memory 402 for execution by the processor(s) 404, for example.

The presentation component(s) 406 present data indications to an operator or to another device. In one example, the presentation components 406 include a display device, speaker, printing component, vibrating component, etc. One skilled in the art will understand and appreciate that computer data is presented in a number of ways, such as visually in a graphical user interface (GUI), audibly through speakers, wirelessly between the computing device 400, across a wired connection, or in other ways. In one example, the presentation component(s) 406 are not used when processes and operations are sufficiently automated that a need for human interaction is lessened or not needed. I/O ports 408 allow the computing device 400 to be logically coupled to other devices including the I/O components 410, some of which is built in. Implementations of the I/O components 410 include, for example but without limitation, a microphone, keyboard, mouse, joystick, pen, game pad, satellite dish, scanner, printer, wireless device, camera, etc.

The computing device 400 includes a bus 416 that directly or indirectly couples the following devices: the memory 402, the one or more processors 404, the one or more presentation components 406, the input/output (I/O) ports 408, the I/O components 410, a power supply 412, and a network component 414. The computing device 400 should not be interpreted as having any dependency or requirement related to any single component or combination of components illustrated therein. The bus 416 represents one or more busses (such as an address bus, data bus, or a combination thereof). Although the various blocks of FIG. 8 are shown with lines for the sake of clarity, some implementations blur functionality over various different components described herein.

The components of the computing device 400 may be connected by various interconnects. Such interconnects may include a Peripheral Component Interconnect (PCI), such as PCI Express, a Universal Serial Bus (USB), firewire (IEEE 1394), an optical bus structure, and the like. In another implementation, components of the computing device 400 may be interconnected by a network. For example, the memory 602 may be comprised of multiple physical memory units located in different physical locations interconnected by a network.

In some examples, the computing device 600 is communicatively coupled to a network 618 using the network component 414. In some examples, the network component 414 includes a network interface card and/or computer-executable instructions (e.g., a driver) for operating the network interface card. In one example, communication between the computing device 400 and other devices occurs using any protocol or mechanism over a wired or wireless connection 420. In some examples, the network component 414 is operable to communicate data over public, private, or hybrid (public and private) connections using a transfer protocol, between devices wirelessly using short range communication technologies (e.g., near-field communication (NFC), Bluetooth® branded communications, or the like), or a combination thereof.

The connection 420 may include, but is not limited to, a modem, a Network Interface Card (NIC), an integrated network interface, a radio frequency transmitter/receiver, an infrared port, a USB connection or other interfaces for connecting the computing device 400 to other computing devices. The connection 420 may transmit and/or receive communication media. In some examples, the connection 420 allows communication with the modular patient lift system 100 to allow, for example, for adjustment of the operation thereof.

Although described in connection with the computing device 400, examples of the disclosure are capable of implementation with numerous other general-purpose or special-purpose computing system environments, configurations, or devices. Implementations of well-known computing systems, environments, and/or configurations that are suitable for use with aspects of the disclosure include, but are not limited to, smart phones, mobile tablets, mobile computing devices, personal computers, server computers, hand-held or laptop devices, multiprocessor systems, gaming consoles, microprocessor-based systems, set top boxes, programmable consumer electronics, mobile telephones, mobile computing and/or communication devices in wearable or accessory form factors (e.g., watches, glasses, headsets, or earphones), network PCs, minicomputers, mainframe computers, distributed computing environments that include any of the above systems or devices, VR devices, holographic device, and the like. Such systems or devices accept input from the user in any way, including from input devices such as a keyboard or pointing device, via gesture input, proximity input (such as by hovering), and/or via voice input.

Implementations of the disclosure, such as controllers or monitors, are described in the general context of computer-executable instructions, such as program modules, executed by one or more computers or other devices in software, firmware, hardware, or a combination thereof. In one example, the computer-executable instructions are organized into one or more computer-executable components or modules. Generally, program modules include, but are not limited to, routines, programs, objects, components, and data structures that perform particular tasks or implement particular abstract data types. In one example, aspects of the disclosure are implemented with any number and organization of such components or modules. For example, aspects of the disclosure are not limited to the specific computer-executable instructions or the specific components or modules illustrated in the figures and described herein. Other examples of the disclosure include different computer-executable instructions or components having more or less functionality than illustrated and described herein. In implementations involving a general-purpose computer, aspects of the disclosure transform the general-purpose computer into a special-purpose computing device when configured to execute the instructions described herein.

By way of example and not limitation, computer readable media comprises computer storage media and communication media. Computer storage media include volatile and nonvolatile, removable, and non-removable memory implemented in any method or technology for storage of information such as computer readable instructions, data structures, program modules, or the like. Computer storage media are tangible and mutually exclusive to communication media. Computer storage media are implemented in hardware and exclude carrier waves and propagated signals. Computer storage media for purposes of this disclosure are not signals per se. In one example, computer storage media include hard disks, flash drives, solid-state memory, phase change random-access memory (PRAM), static random-access memory (SRAM), dynamic random-access memory (DRAM), other types of random-access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transmission medium used to store information for access by a computing device. In contrast, communication media typically embody computer readable instructions, data structures, program modules, or the like in a modulated data signal such as a carrier wave or other transport mechanism and include any information delivery media.

While various spatial and directional terms, including but not limited to top, bottom, lower, mid, lateral, horizontal, vertical, front and the like are used to describe the present disclosure, it is understood that such terms are merely used with respect to the orientations shown in the drawings. The orientations can be inverted, rotated, or otherwise changed, such that an upper portion is a lower portion, and vice versa, horizontal becomes vertical, and the like.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Various operations of implementations are provided herein. In one implementation, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each implementation provided herein.

Any range or value given herein can be extended or altered without losing the effect sought, as will be apparent to the skilled person.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

Although examples described herein are described in connection with a particular air handling arrangement and environment, the present disclosure can be implemented in different arrangements and in different environments. For example, the present disclosure is implementable in any application or environment in which air flow control is desired.

As used in this application, the terms "component," "module," "system," "interface," and the like are generally intended to refer to a computer-related entity, either hardware, a combination of hardware and software, software, or software in execution. For example, a component may be, but is not limited to being, a process running on a processor, a processor, an object, an executable, a thread of execution, a program and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable device, carrier or media. Of course, those skilled in the art will recognize many modifications may be made to this configuration without departing from the scope or spirit of the claimed subject matter.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A modular return air device comprising:

a body;

a first air return configured to facilitate incoming air to enter the body, the body comprising a grille and a damper;

one or more sensors configured to collect data regarding the incoming air;

a disinfecting unit configured to:

receive one or more measurement from the one or more sensors, identify at least one type of disinfecting element, identify an amount of disinfecting element, identify an amount of time to activate the disinfecting element, and disinfect the incoming air entering the body using the identified at least one type of disinfecting element, the identified amount of disinfecting element, and the identified amount of time; and a second air return configured to facilitate the air to exit the body of the modular return air device.

2. The modular return air device of claim 1, further comprising a heating and cooling unit.

3. The modular return air device of claim 1, further comprising a status indicator configured to indicate a status relating to collected data from the one or more sensors.

4. The modular return air device of claim 1, further comprising a motor and fan within the body configured to adjust an airflow through the body.

5. The modular return air device of claim 1, further comprising one or more covings forming a seal between the body and one or more walls.

6. The modular return air device of claim 1, wherein the grille is coupled to the body via a hinge and is movably coupled to the body via a no-tool latch.

7. The modular return air device of claim 1, further comprising an air chase configured to allow airflow therethrough and a race way defining a channel configured to receive therein one or more cables, the race way physically separated from air flowing through the air chase.

8. The modular return air device of claim 1, further comprising an integrated shelf formed along at least a portion of the body.

9. The modular return air device of claim 1, further comprising a controller configured to receive the collected data from the one or more sensors and adjust one or more settings to change one or more of an air quality or an air characteristic within a room.

10. The modular return air device of claim 9, wherein the room is a surgical suite and the controller comprises an electronic control module configured to control airflow throughout the surgical suite based on the collected data from the one or more sensors.

11. A modular return air device comprising:

a body;

a first air return configured to receive incoming air into the body, the body comprising a grille and a damper, wherein the incoming air is received from a room;

a second air return configured to allow air to exit the body and enter the room, wherein the body is configured for modular installation within the room; and a disinfecting unit configured to:

receive one or more measurement from the one or more sensors, identify at least one type of disinfecting element, identify an amount of disinfecting element, identify an amount of time to activate the disinfecting element; and disinfect the incoming air using the identified at least one type of disinfecting element, the identified amount of disinfecting element, and the identified amount of time, wherein incoming air enters the body via the first air return, is directed to the disinfecting unit, and exits the body via the second air return, thereby disinfecting surfaces within the room.

12. The modular return air device of claim 11, further comprising one or more sensors configured to collect data regarding the incoming air.

13. The modular return air device of claim 11, further comprising a status indicator configured to indicate a status relating to collected data from the one or more sensors.

14. The modular return air device of claim 11, further comprising a motor and fan within the body configured to adjust an airflow through the body.

15. The modular return air device of claim 11, wherein the grille is coupled to the body via a hinge and is movably coupled to the body via a no-tool latch.

16. The modular return air device of claim 11, further comprising an air chase configured to allow airflow therethrough and a race way defining a channel configured to receive therein one or more cables, the race way physically separated from air flowing through the air chase.

17. The modular return air device of claim 1, further comprising an integrated shelf formed along at least a portion of the body.

* * * * *